United States Patent [19]

Cozzutto et al.

[11] Patent Number: 4,815,255

[45] Date of Patent: Mar. 28, 1989

[54] PLASTIC BAG PLACEMENT APPARATUS AND METHOD

[75] Inventors: Lyndon L. Cozzutto, Aberdeen; James D. Henry, Ocean City, both of Wash.; Michael E. Hawley, Beaconsfield, Canada

[73] Assignee: Enterprises International, Inc., Hoquiam, Wash.

[21] Appl. No.: 94,652

[22] Filed: Sep. 9, 1987

[51] Int. Cl.[4] ..... B65B 7/06

[52] U.S. Cl. ..... 53/459; 53/386; 53/567

[58] Field of Search ..... 53/459, 469, 468, 386, 53/384, 385, 567, 573, 571, 570; 141/114, 10

[56] References Cited

U.S. PATENT DOCUMENTS

| | | | |
|---|---|---|---|
| 2,814,488 | 11/1957 | Kipers | 53/386 X |
| 2,973,612 | 3/1961 | McGowan | 53/386 X |
| 3,490,195 | 1/1970 | Abramson | 53/386 X |
| 3,492,780 | 2/1970 | Bastasch | 53/386 |
| 3,607,574 | 9/1971 | Satake | 53/567 X |
| 3,706,179 | 11/1972 | Tanaka et al. | 53/386 X |
| 3,710,541 | 1/1973 | Izumi | 53/386 X |
| 3,789,573 | 2/1974 | Crabb | 53/386 X |
| 3,830,038 | 8/1974 | Propst | 53/386 X |
| 3,934,388 | 1/1976 | Stradlbauer et al. | 53/459 |
| 4,137,958 | 2/1979 | Golby et al. | 53/386 X |
| 4,241,562 | 12/1980 | Meyer | 53/385 X |
| 4,345,629 | 8/1982 | Inglett, Jr. | 141/114 |
| 4,510,736 | 4/1985 | Müller | 53/567 |
| 4,522,012 | 6/1985 | Nelson | 53/386 X |
| 4,537,015 | 8/1985 | Inglett, Jr. et al. | 53/386 |
| 4,563,864 | 1/1986 | Eschmann | 141/114 X |
| 4,586,318 | 5/1986 | Litt et al. | 53/459 |
| 4,674,268 | 6/1987 | Gavronsky et al. | 141/10 X |

FOREIGN PATENT DOCUMENTS

| | | | |
|---|---|---|---|
| 1511755 | 10/1969 | Fed. Rep. of Germany | 53/567 |

*Primary Examiner*—James F. Coan

*Attorney, Agent, or Firm*—Seed and Berry

[57] ABSTRACT

A plastic bag removal method and apparatus in which the bag is stored on a large, tightly compressed roll. In the described preferred embodiment, the method and apparatus provide for opening the mouth of the leading bag on the roll, clamping the inside and outside surfaces of each of the opposite side edges of the mouth, pulling the bag out, away from the roll, while still clamping, in order to expose the next bag in the roll, holding the mouth of the next bag in the roll while twisting the leading bag and continuing to pull on the leading bag until the sealed bottom of the bag separates from the next bag held in the roll, and placing that leading open bag onto a filling spout.

18 Claims, 3 Drawing Sheets

PLASTIC BAG PLACEMENT APPARATUS AND METHOD

DESCRIPTION

1. Technical Field

The present invention relates generally to plastic bag removal methods and equipment in which the plastic bag is stored on a large, tightly compressed roll.

2. Background Art

Plastic gusseted bags used for packaging of soft, highly compressed bulk materials, such as fiberglass insulation, are generally delivered to the filling location in a large, tightly compressed roll. In this compressed condition, the layers of the bags and gusset side folds tend to stick tightly together, particularly when the bags are in the inner core of the roll, making it difficult to open the bag and to separate the bag from the roll. Suction devices have been tried in the past to open the bag and remove it from the roll, but they have been found to be unsuccessful.

Opening of gusseted plastic bags is even more difficult. A gusseted bag is frequently made up of multi-layers of plastic, for example, three layers, with folded side edges. When these edges get compressed near the core of the roll, they tend to stick tightly together and are difficult to open. It is also important in the process of opening these gusseted bags not to knock the bag off the bag opening machanism.

DISCLOSURE OF THE INVENTION

It is an object of this invention to provide a method and an apparatus for separating a tightly compressed plastic bag from a roll and placing it on a bag-filling spout.

Basically, the method employs the steps of opening the mouth of the leading bag on the roll, clamping the inside and outside surfaces of each of the opposite side edges of the mouth, pulling the bag out, away from the roll, while still clamping, in order to expose the next bag in the roll, holding the mouth of the next bag in the roll while twisting the leading bag and continuing to pull on the leading bag until the sealed bottom of the bag separates from the next bag held in the roll, and placing that leading open bag onto a filling spout.

Basically, the apparatus employs means for partially opening the opposite side edges of the mouth of the leading bag in the roll, inserting clamping paddles into the partially open mouth, and clamping pads against the opposite sides of the surfaces of the edge of the bag, clamping the edge of the bag mouth at four locations between the pads and the paddles. The paddles separate to define the rectangular side corners of the mouth of the bag so that it is stretched and fully open so that it may be placed on the filling spout.

The apparatus and method uniquely employ a corner trapping technique that enables the four corners of a gusseted bag to be held sufficiently tight that the sticking gussets will separate and the bag mouth can be opened to its full extent without the bag slipping off the bag opening mechanism. In the preferred apparatus, this corner trapping technique employs paddles having knobs on their outer ends for dimpling or stretching the plastic. The paddles and knobs press or pinch the plastic against resilient blocks or pads. The corner is dimpled and stretched in one direction and squeezed tightly in a second direction perpendicular to the dimpling direction to keep the bag from slipping off the paddles. The stretching also eliminates any loose plastic folds that could catch on the bag-filling nozzle and tear or be knocked off the paddles.

BEST MODE OF CARRYING OUT THE INVENTION

Figure 1:
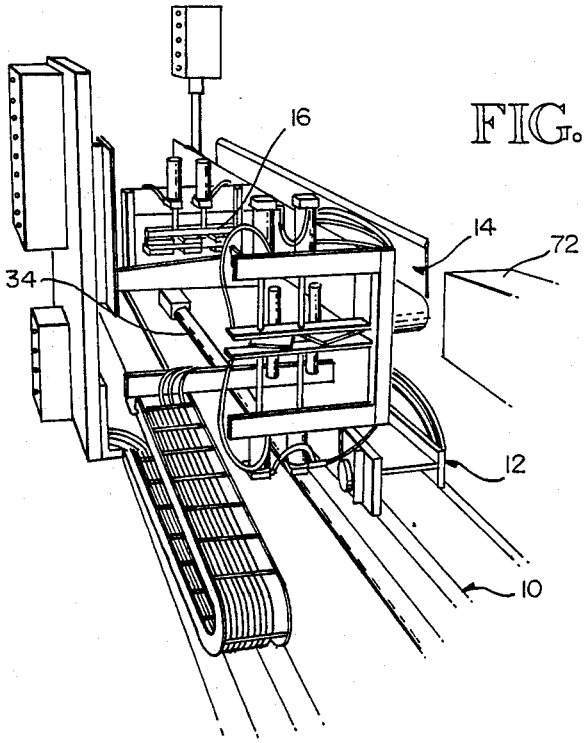
FIG. 1 is a perspective of an overall view of the bag-placing apparatus employing the steps of the method.

As best shown in FIG. 1, the bag-placing apparatus includes a track 10 on which is mounted a trolley 12. The trolley mounts a carriage 14.

Figure 2:
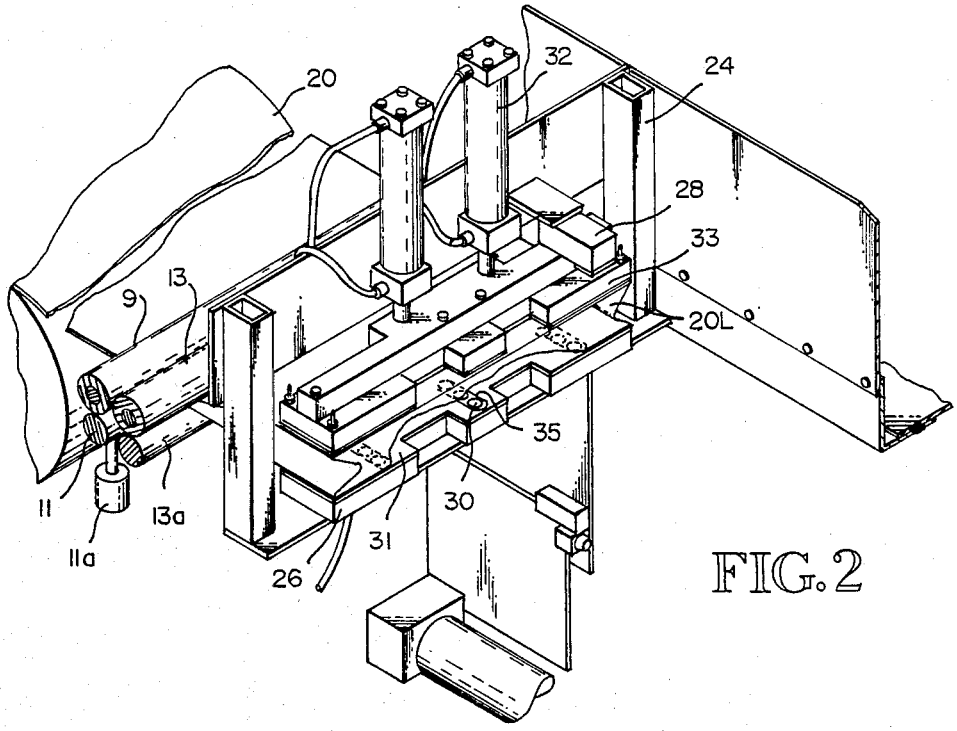
FIG. 2 is a fragmentary isometric of a portion of the bag-placing apparatus.

A rubber-covered power roller 9 rotates clockwise in FIG. 2 to draw the bag material back into proper alignment between the suction bars 26 and 33. Ideally, only about three-quarters of an inch of the front edge of the leading bag 20L should be protruding from the suction bars. A pinch roller 11 is raised to pinch the plastic bag against the powered roller when the bag is drawn back after each cycle of operation. The pinch roller is raised by an actuator 11a. A set of non-driven pinch rollers 13 and 13a provide a slight friction drag at all times on the bag to keep the weight of the bags on the roll from drawing the leading bag rearwardly out of the bag mouth opening assembly.

A bag mouth opening assembly 16 is mounted adjacent the roll of plastic bags 20, which is mounted in a conventional spindle or dispenser, the details of which are not shown. The leading bag 20L is passed into the bag mouth opening assembly 16.

The bag mouth opening assembly 16 includes a fixed frame 24 having a stationary lower suction bar 26 and a movable upper suction bar 33. The suction bars are each provided with conventional suction cups 30 which provide a considerable surface area of suction to the external surfaces of the edges of the mouth of the leading bag 20L. Actuators 32 raise and lower the movable upper bar 33.

The suction bars 26 and 33 include a plurality of individual suction cups 30 that protrude outwardly from the suction bars in slots 35 of a resilient plate 31. There are preferably three sets of slots and three suction cups provided per each slot in the resilient plate. Initially, the suction cups open the mouth of the bag. However, when the sealed bottom of the leading bag 20L is to be separated from the mouth of the next bag on the roll, the resilient plates 31 are pressed tightly together to provide a high-friction surface and a firm tearing surface. As the leading bag 20L is then pulled and twisted, the resilient plates hold the mouth of the next bag tightly so that a clean severing can take place between the sealed end of the leading bag and the bag still attached to the roll.

The trolley 12 is reciprocated toward and away from the bag mouth opening assembly by an elongated actuator 34 (FIG. 1). The carriage 14 is provided with a pair of upper and lower support arms 36 and 37, respectively. Each support arm carries a pair of actuators 38 which mount a movable frame 40. The movable frame is basically the same on both the upper and lower arms. Accordingly, only the upper movable frame will be described.

Figure 5:
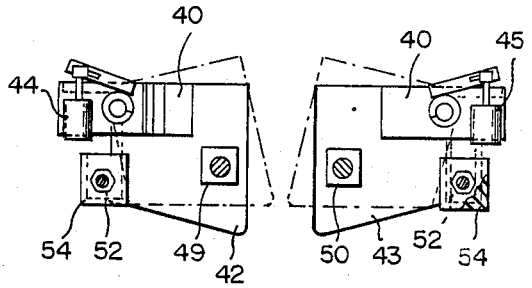
FIG. 5 is a fragmentary schematic looking down at the bag clamping and opening paddles shown in FIG. 3.

The movable frame 40 carries a pair of paddles 42 and 43, which are pivoted by actuators 44 and 45 from the dotted-line position shown in FIG. 5 to the extended position shown in solid lines. Mounted adjacent to the outside, or upper, surface of the paddles 42 and 43 are actuators 47 and 48, each of which carries an extendible pad 49 and 50, respectively.

The clamping pads are moved down to trap the plastic surface around the edge of the bag mouth against the face of the paddle. This occurs while the paddles are inserted between the vacuum-suction bars 26 and 33 at the bag mouth opening assembly 16. The paddles in that location have already been rotated outwardly into the solid-line position shown in FIG. 5, but do not contact the sides of the gusseted bag.

The clamped mouth of the bag is then pulled out of the bag mouth opening assembly, and the paddles are spread away from one another in a direction perpendicular to the plane of the paddles by the actuators 38. The outer corners of each of the paddles are each provided with a knob 52. The knob stretches or dimples the corner of the bag to hold it tightly and to keep the bag from slipping off the paddles. As the paddles become fully extended, the corner of the paddles adjacent the knob pinches the plastic of a bag against a rubber pad or block 54. The plastic is pressed in and deforms the rubber pad. In this condition, all four corners of the mouth of the bag are clamped tightly in the direction perpendicular to the plane of the paddles and stretched or dimpled tightly over the knobs on the corners of the paddles. This positively traps the four corners so that they cannot slip off the paddles during subsequent rotation and tearing of the bag off the roll. This is very important, particularly when dealing with gusseted bags, as it is important to get the bag completely spread open so that there are no loose surfaces of plastic and so that the gusset gets completely opened before trying to place the bag onto the bag-filling spout. It is also important that the corners be trapped adequately so that they do not slip off the paddles as the bag is being torn from the roll.

Figure 3:
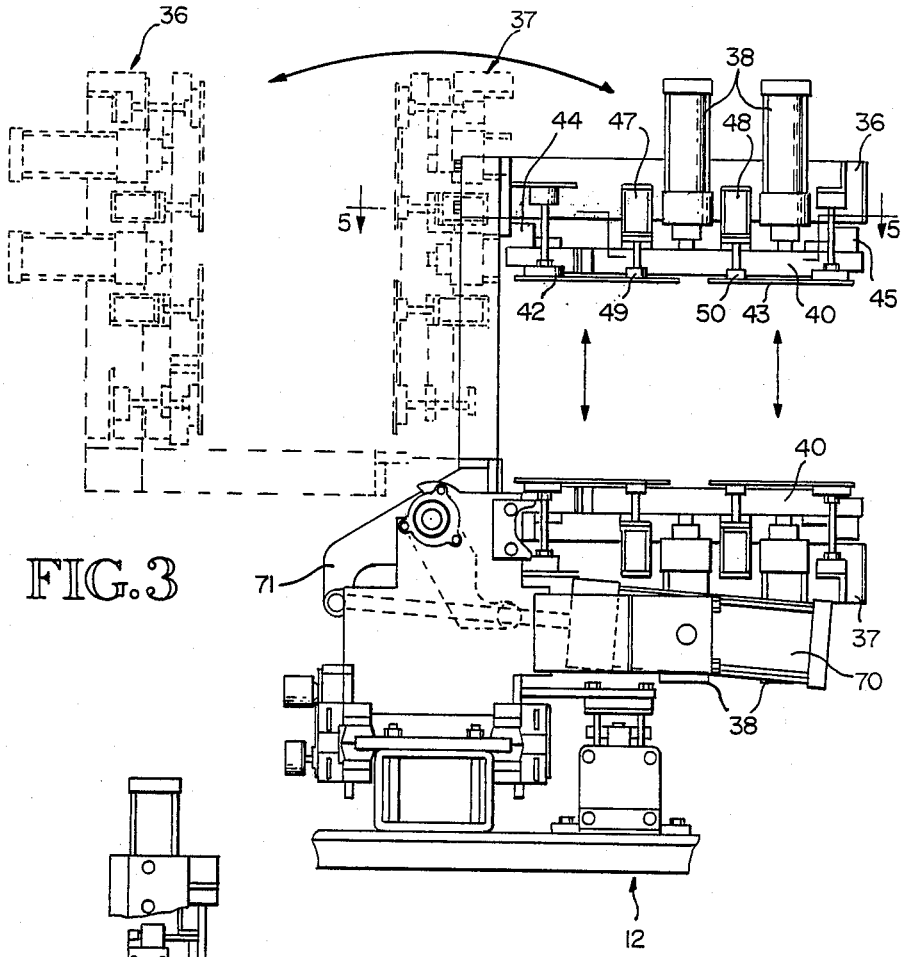
FIG. 3 is a fragmentary side elevation of a portion of the bag-placing apparatus.
Figure 4:
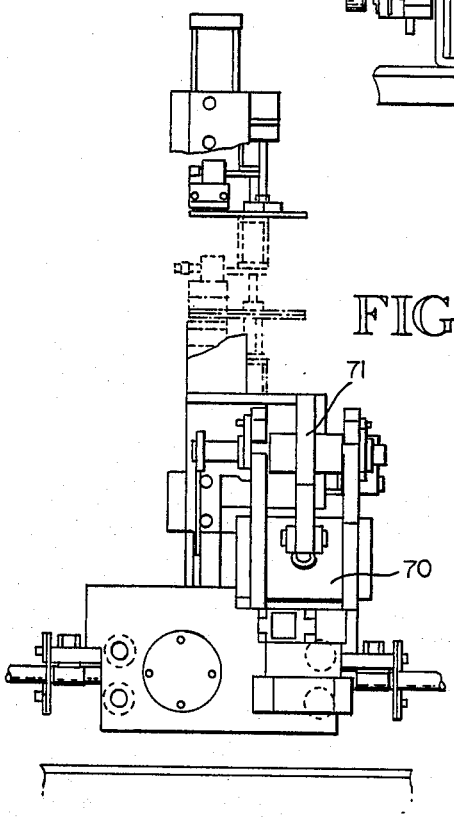
FIG. 4 is an end elevation of the portion of the bag-placing apparatus shown in FIG. 3.

As best shown in FIG. 3, an actuator 70 is connected to a bell crank 71 that is mounted to the frame that supports the arms 36 and 37. The actuator can rotate the arms into the dotted-line position. In the dotted-line position, the bag is then in position to be placed over the filling spout 72.

The operation of the apparatus and method is best illustrated in FIGS. 6–9.

Figure 6:
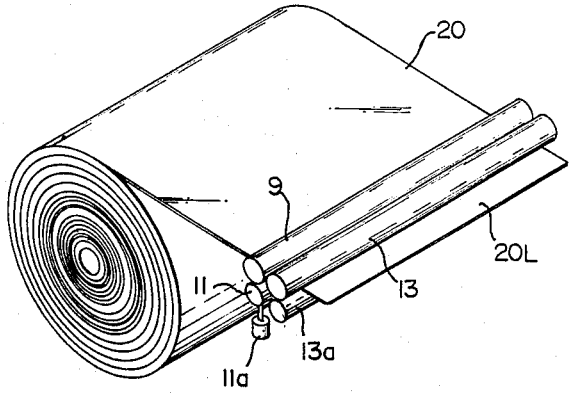
FIG. 6 is a schematic showing the bag on a roll.
Figure 7:
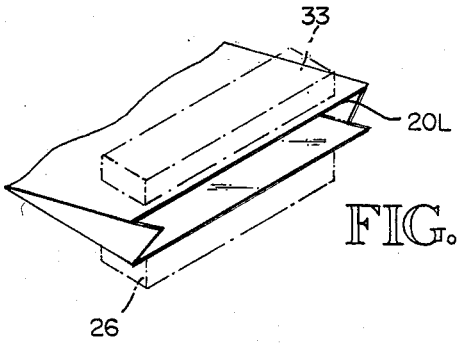
FIG. 7 shows the first step of opening the mouth of the bag on the roll.
Figure 8:
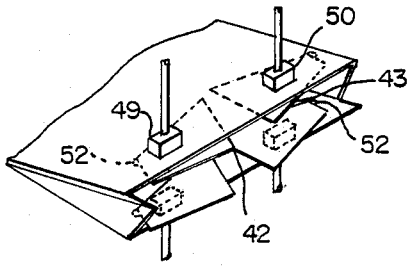
FIG. 8 shows the initial step of opening the bag and clamping it so that it can be pulled from the roll.
Figure 9:
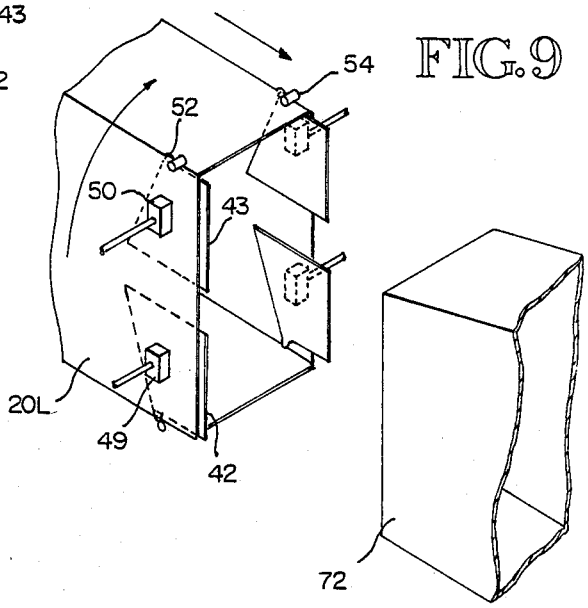
FIG. 9 shows a final step in which the open bag is about to be placed over a filling spout.

As best shown in FIG. 6, the bag is pulled off the roll by the carriage 14. When the leading bag 20L is placed beneath the suction cups in the bag mouth opening assembly 16, the suction grips the surfaces of the bag and the upper suction bar 33 is raised to open the bag slightly, as shown in FIG. 7. At this time, the carriage has moved forward and inserts the paddles into the open end of the bag. The paddles have been rotated away from one another into their open position prior to entering the bag.

The clamps 49 and 50 then come down and pinch the bag against the paddles 42 and 43. All four of the paddles move away from one another in the direction perpendicular to the plane of the paddles until the paddle are fully opened. In this condition, best shown in FIG. 9, the knobs 52 have dimpled the bags. The paddles have pinched the bag against the resilient pads 54. Next, the carriage is rotated into the position shown in FIG. 9 and the bag moved over the bag-filling nozzle.

The paddles then begin to move in as the carriage is moved away, and the machine is recycled.

While the preferred embodiments of the invention have been illustrated and described, it should be understood that variations will be apparent to those skilled in the art. Accordingly, the invention is not to be limited to the specific embodiments illustrated in the drawing.

We claim:

1. A method of removing plastic bags of the type having a mouth defined by opposite side edges and a sealed bottom removably joined to the next bag mouth from a roll where the bags are tightly compressed and difficult to separate, and placing the bags onto a filling spout, comprising:

opening the mouth of the leading bag on the roll;

clamping the inside and outside surfaces of each of the opposite side edges of the mouth;

while still clamping, pulling out the bag from the roll to expose the next bag in the roll;

holding the mouth of the next bag in the roll while twisting the leading bag and continuing to pull on the leading bag until the sealed bottom of the bag separates from the next bag held in the roll; and placing the leading open bag onto a filling spout.

2. The method of claim 1, including the step of separating the opposite side edges of the mouth of the bag by pulling the side edges away from one another at widely laterally spaced points on each side edge to define a generally rectangular open bag mouth.

3. The method of claim 2 wherein said step of separating the opposite side edges to define the generally rectangular open bag mouth occurs while pulling the bag from the roll.

4. The method of claim 1 wherein said step of clamping the inside and outside surfaces of the opposite side edges of the opened bag mouth includes at the four corners of the mouth of the bag and stretching a small area of the side edge surfaces at each corner to form a dimple to increase the pulling force on the bag.

5. The method of claim 3 wherein said step of clamping the inside and outside surfaces of the opposite side edges of the bag mouth includes clamping along substantially the entire surface of each edge.

6. The method of claim 1, including the step of withdrawing rearwardly the next remaining bag on the roll after a leading bag is separated from the roll to properly align the next remaining bag for opening.

7. The method of claim 4 wherein the step of clamping at the four corners of the opened mouth of the bag includes pressing the side edge surface of the bag against a resilient pad.

8. Apparatus for removing tightly compressed plastic bags from a roll of bags, each bag having a mouth defined by opposite side edges and a sealed end separable from the roll by perforation adjacent the sealed end, comprising:

means for partially opening the opposite side edges of the mouth of the leading bag on the roll;

paddles insertable into the partially open mouth;

clamping pads engagable with the outside of the side edges of the open mouth in opposed alignment with the paddles;

means for inserting the paddles into the mouth of the bag and closing the pads and paddles together to pinch the opposite side edges of the bag mouth;

means for twisting and pulling the pinched bag mouth outwardly from the roll to expose the next bag on the roll;

means for holding tightly the mouth of the next bag on the roll while continuing to twist and pull to separate the leading bag from the roll;

means for fully opening the mouth of the leading bag; and means for placing the fully opened mouth of the leading bag onto a filling spout.

9. The apparatus of claim 8, said means for partially opening the opposite side edges of the bag mouth including suction members for engaging the outside surfaces opf the side edges adjacent the mouth of the bag, and said means for holding the mouth of the next bag on the roll during separation of the leading bag including a resilient clamping plate having slots for housing suction cups and means for pressing the opposite suction cups and clamping bars toward one another until the resilient clamping plates tighlty squeeze the opposed outside surfaces of the mouth side edges to define a positive high-function clamping force for cleanly separating at the perforation the sealed end of the leading bag from the next bag on the roll.

10. The apparatus of claim 8, said paddles extending substantially the entire width of the side edges of the mouth of the bag.

11. The apparatus of claim 8, said paddles including two paddles on each side of the mouth, each paddle having a lateral outer edge for defining a corner of the open mouth of the bag, a knob on the outer edge of each paddle, the knob adapted to stretch the plastic of the bag when the paddles are extended to fully open the mouth of the bag, and said paddles extending in combination substantially the entire width of the side edges of the mouth of the bag.

12. The apparatus of claim 8, said paddles including two pivotally mounted paddles, and said means for inserting the paddles into the mouth of the bag and closing the pads and paddles together including actuators for pivoting the paddles into the open mouth in a direction in the plane of the paddles.

13. The apparatus of claim 8, said means for twisting and pulling the bag including an elongated track, a trolley mounted for movement along the track and a carriage mounted for pivotal movement of said trolley, and said clamping pads and paddles being mounted on said carriage, whereby movement of said trolley and carriage pull and twist the paddles and pads to remove the leading bag from the roll.

14. The apparatus of claim 13, said carriage including a pair of spaced opposed arms, said clamps and paddles being mounted on actuators carried by said arms, said actuators being extendible away from said arms toward the opposite arm to position the paddles and clamps at the partially opened bag mouth, and said actuators being retractable after the paddles are in the bag mouth and the clamps closed against the outside surface of the bag edge to fully open the bag mouth.

15. The apparatus of claim 8, including a main frame having a track, a trolley mounted on said track, and a carriage mounted on the trolley, said paddles, and clamping pods being mounted on said carriage, said means for partially opening the bag being mounted at a first end of said track, said means for twisting and pulling the pinched bag mouth outwardly from the roll including means for moving the trolley away from said means for partially opening the bag mouth.

16. The apparatus of claim 12, a resilient block stationarily mounted near each paddle, each paddle when fully extended to open the mouth of the bag, pressing the bag tightly into the resilient block for gripping the corners of the bag mouth.

17. The apparatus of claim 16, the outer edges of said paddles each having a knob, said knob adapted to stretch the plastic to grip the bag mouth, said paddles, resilient blocks and knobs all tightly trapping the four corners of the bag mouth to provide a positive pulling force of the bag.

18. The apparatus of claim 8, including means for aligning the forward edge of a forward bag mouth adjacent said means for partially opening the bag mouth, said aligning means including a powered drawback roller, a pinch roller pressed toward said drawback roller for pinching the bag between its mouth and the roll, drawback roller being operative to pull the leading bag back slightly to reposition the bag mouth beneath the means for partially opening the bag mouth.

* * * * *

UNITED STATES PATENT AND TRADEMARK OFFICE

CERTIFICATE OF CORRECTION

PATENT NO. : 4,815,255

DATED : March 28, 1989

INVENTOR(S) : Lyndon L. Cozzutto et al.

It is certified that error appears in the above-identified patent and that said Letters Patent is hereby corrected as shown below:

In claim 9, column 5, line 23, delete "opf", and substitute therefor with --of--.

In claim 9, column 5, line 29, delete "tighlty", and substitute therefor with --tightly--.

In claim 15. column 6, line 23, delete "paddles", and substitute therefor with --paddle--.

In claim 17, column 6, line 39, delete "of", and substitute therefor with --on--.

Signed and Sealed this

Ninth Day of January, 1990

*Attest:*

JEFFREY M. SAMUELS

*Attesting Officer*

*Acting Commissioner of Patents and Trademarks*